United States Patent [19]

Buchholz et al.

[11] 4,390,126

[45] Jun. 28, 1983

[54] PROCESS FOR SUPPLYING PAINTING LINES WITH PAINT

[75] Inventors: Hagen Buchholz, Münster; Hans-Dieter Johannsmeier, Nottuln; Friedrich Vock, Münster, all of Fed. Rep. of Germany

[73] Assignee: BASF Farben & Fasern A.G., Hamburg, Fed. Rep. of Germany

[21] Appl. No.: 154,872

[22] Filed: May 30, 1980

[30] Foreign Application Priority Data

Jun. 13, 1979 [DE] Fed. Rep. of Germany ..... 2923906

[51] Int. Cl.[3] ..... B05D 1/02; B05C 21/00; B05B 7/32

[52] U.S. Cl. ..... 239/1; 137/209; 137/265; 137/563; 239/66; 239/124; 239/373

[58] Field of Search ..... 239/1, 66, 124, 373; 137/207.5, 209, 265, 563

[56] References Cited

U.S. PATENT DOCUMENTS

| | | | |
|---|---|---|---|
| 2,056,568 | 10/1936 | Davis | 137/207.5 |
| 2,266,354 | 12/1941 | Christenson et al. | 137/563 X |
| 3,061,198 | 10/1962 | Kerr et al. | 239/124 X |
| 3,893,625 | 7/1975 | Wiggins | 239/127 |

*Primary Examiner*—Andres Kashnikow
*Attorney, Agent, or Firm*—Wells & Wells

[57] ABSTRACT

Spray paint lines, in particular the spray sites in spray booths of auto assembly lines, are provided with the paint material by means of a pump delivering the paint material into the main ring. The pressure level required for spraying the paint is adjusted by means of a pressurized vessel and a pressurized gas above the liquid level. A second pump conveys fresh paint material into the pressurized vessel.

15 Claims, 7 Drawing Figures

PROCESS FOR SUPPLYING PAINTING LINES WITH PAINT

Figure 1:
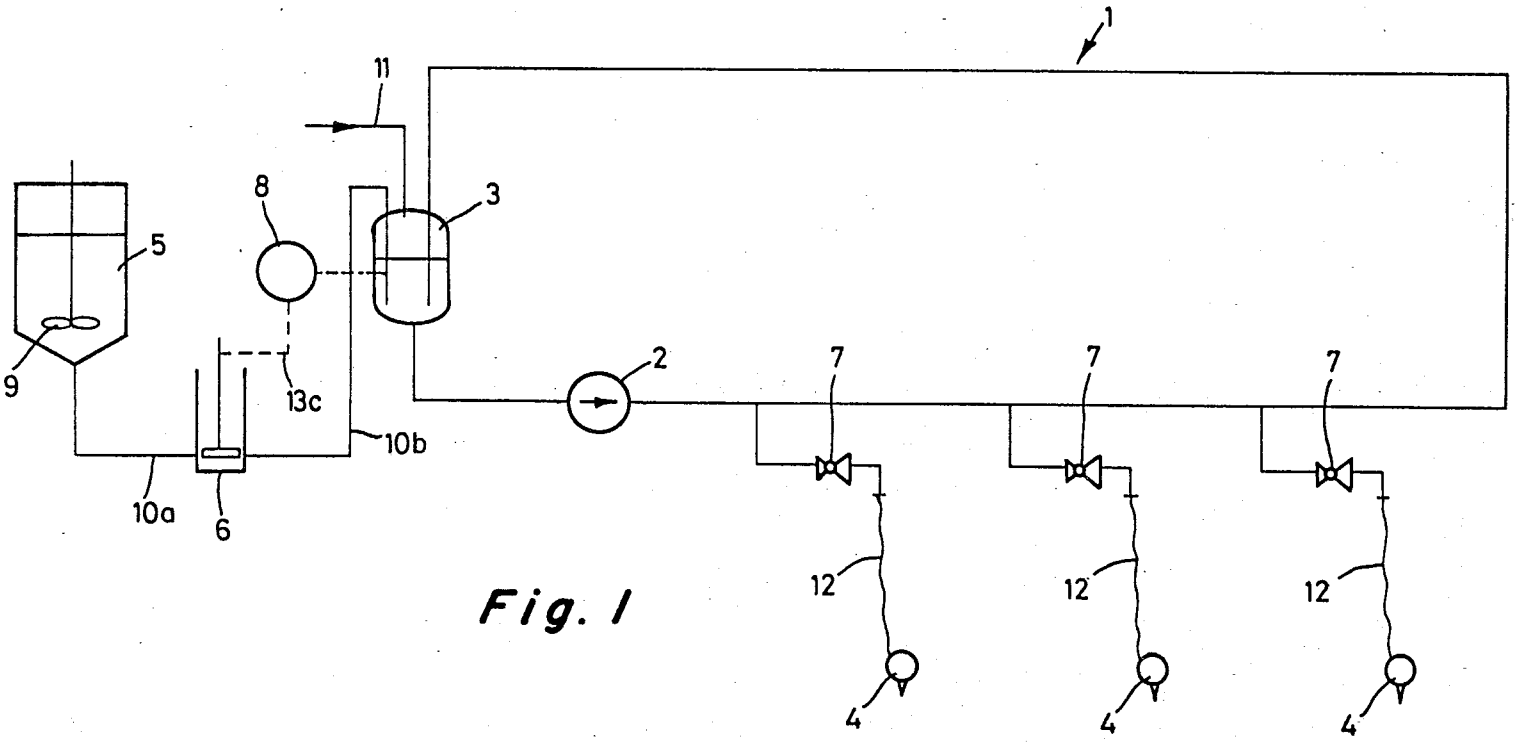

The invention relates to a unit for supplying painting lines, in particular the spraying points in spray booths, with paint material.

On large painting lines, such as are conventionally used, for example, in the automobile industry for the painting of raw bodies, the paint-spraying points are supplied with the necessary paints via ring main installations. A separate ring main installation is required for each hue and each paint material. Depending on the size and fitting-out of the unit, up to 20 spraying points, for example, are installed per hue, in particular for manual spraying.

The paint-supplying unit here essentially consists of an unpressurized vessel with an agitator, a pump and a length of pipe in which the paint material is passed along the spray booths, the pressures and quantities required for spraying being adjusted by means of restrictor fittings. The ring main carries the paint material back into the vessel. This recirculation process is carried out in order to prevent sedimentation of particles in the pipes. When all the spraying points are operating, about 60% of the paint material delivered by the pump into the ring main are used for spraying, whilst 40% are returned to the vessel.

The pressure level in the ring main is set on a return flow control valve, which is located in the ring main between the last spraying point and the paint batch vessel, and which appropriately restricts the volumetric flow of paint.

For this process, ring main installations have been disclosed which have an overall length of up to more than 300 m, the mean flow velocities in the free pipe cross-section customarily being between 0.2 and 0.5 m/s. The circulation pumps are either piston pumps driven by compressed air or multi-stage centrifugal pumps. Normally, these pumps have to provide a pressure difference of from 8 to 12 bar, of which the return flow control valve alone throttles about 3 to 5 bar, whilst the remainder of the available pressure is dissipated by the pressure drop of the flow in the pipe.

Atmospheric pressure prevails in the vessel used as the paint batch vessel. The paint material flows to the pump and its pressure is raised. In the length of pipe itself, the pressure falls again due to the pressure drop and, for each spraying point, a pressure-reducing valve is provided which, independently of the distance of the spraying point from the pump, ensures the same pressure at all the spraying points.

The paint materials contain binders or binder mixtures, which are present in solution in suitable solvent mixtures, as well as pigment mixtures and extender mixtures. The solvent can also be water and, furthermore, secondary paint dispersions can be envisaged in which the binder is present undissolved in an aqueous phase or in an organic phase. Furthermore, metallic-base paints must also be conveyed in which, for example, aluminum bronze is present in the form of metallic flakes.

All these paint systems pass through mixing stages and dispersing stages during the production process. In these stages, in particular, the pigment and extender contents are distributed in fine dispersion and are wetted. These processes are essentially based on a mechanical shear load and/or impact load on the solid particles in suitable binder/solvent systems, the intensity and frequency of loading, in conjunction with surface-active effects, being responsible for success. Paint materials are thus produced which, with respect to their coloristic, mechanical and corrosion-inhibiting properties and with respect to their visual appearance and processability, have stable long-term characteristics.

It has been found that the paint materials in the paint-supplying installations in painting lines are again stressed additionally by shear flows in ring main installations and fittings. It is known that some paint materials do not remain stable, with respect to some of their characteristic criteria, under this stress in paint-supplying installations.

An estimate of the shear stress to which paint materials are subjected when flowing through ring main installations is given below, using the following specific Example:

| | |
|---|---|
| Diameter of the ring main | $d_R = 25$ mm |
| Overall length of the ring main | $L = 300$ m |
| Mean flow velocity in the free pipe cross-section | $v = 0.3$ m/s |
| Dynamic viscosity of the paint material | $\eta = 0.12$ Pa · s |
| Density of the paint material | $\rho = 1.1$ kg/l |

By means of the Reynolds number, it must be checked whether the flow in the pipe of the ring main is laminar or turbulent.

$$Re=(v\cdot d_R\cdot\rho)/\eta \quad (1)$$

With the data indicated, the resulting Reynolds number is $$Re\approx 70$$

This means that the flow in the pipe is laminar (the flow in pipes is laminar if Re is <2,300).

The pressure drop in pipes is $$\Delta p=\lambda\cdot(L/d_R)\cdot(\rho/2)\cdot v^2 \quad (2)$$

and the resistance coefficient for laminar flow is $$\lambda=64/Re \quad (3)$$

In the laminar case, this gives a pressure drop of the flow in the pipe of:

$$\Delta p=32\cdot(L/d_R^2)\cdot\eta\cdot v \quad (4)$$

With (4) and the data indicated, the resulting pressure drop per unit length of pipe is $$(\Delta p/L)\approx 0.02\ bar/m$$

With a pipe length of 300 m, the pump must supply a delivery pressure head of $$\Delta p\approx 5.5\ bar$$

merely for conveying through the pipe (without fittings).

If a velocity in the pipe of 0.5 m/s is to be maintained, this value increases to 9.2 bar.

The next question concerns the stress to which the pigment in the paint material is subjected by the shear flow. The specific energy is:

$$E/V_{Pig}=\eta\cdot\kappa^2\cdot(t_s/c_v)$$

wherein $E/V_{Pig}$ is the specific dissipation energy, relative to the volume proportion of pigment in the paint, in $Ws/m^3$, $\kappa=dv/dr$ is the shear gradient in 1/s, $t_s$ is the shear time in s and $c_v$ is the pigment concentration by volume (PVK).

With a PVK of $c_v=0.08$ and the data indicated, the result is:

For L=300 m and v=0.3 m/s, the shear time in the pipe per cycle is $t_s=1{,}000$ s and the shear gradient is $$\kappa=24(l/s)$$

This gives:

$$E/V=864{,}000\ Ws/m^3$$

per 1 cycle or $$E/V=0.24\ KWh/m^3$$

per 1 cycle.

This specific energy is so small that a significant dispersing action on the pigments due to the shear flow in the pipe can be excluded.

The dissipation energy on return flow control valves is substantially greater:

| | |
|---|---|
| Assumptions: | |
| Pressure drop at the valve | $\Delta p_v = 3$ bar |
| Paint throughput | $\dot{V} = 0.5$ l/s |
| Valve volume in which shear takes place | $V = 1\ cm^3$ |
| Shear time in the valve volume | $t_s = \frac{1}{500}$ s |

This gives a power density, relative to the paint volume, of $$N/V=150\cdot10^3\ KW/m^3 \text{ per pass}$$

and an energy density, relative to the paint volume, of $$E/V=83\ KWh/m^3 \text{ per pass.}$$

If the energy density is related via the PVK of c=0.08 to the pigment volume, the result is $$E/V_{Pig}=1038\ KWh/m^3 \text{ per pass.}$$

This value increases in direct proportion to the number of recirculation steps of the paint in the ring main.

It can be seen that the shear stress intensity on pigment particles in the paint can be 4,000 to 5,000 times greater in restrictor fittings than in the pipe.

Investigations show, however, precisely that the degree of dispersivity of pigments in paints is changed whenever there is a shear flow, acting on the pigment, at energy densities of more than 300 to 500 $KWh/m^3$. This limiting value depends on the nature of the pigment and the binder solution.

A change in the degree of dispersivity of pigments in paints due to the shear stress in ring mains can, however, lead to shifts of the color intensity, the hue and the gloss properties of the paint.

It is found that the instability threshold of a paint material can be reached as a result of the given intensity and frequency of stress, in particular in restrictor fittings and pumps of paint-supplying systems.

It is the object of the invention to provide a system concept for paint-supplying installations, which eliminates the abovementioned disadvantages.

This object of the invention is achieved by the following embodiments:

A. A process as shown in FIG. 1 for supplying painting lines, in particular the spraying points in spray booths, with paint material, wherein:

(a) the pressure level required for paint-spraying is set using a pressure vessel (3) and a pressurizing gas (at 11) above the liquid level;

(b) the paint material is circulated, by means of a pump (2); from the pressure vessel (3) via a ring main (1) back into the pressure vessel (3); and (c) fresh paint material (at 5) is fed to the pressure vessel (3) by means of a second pump (6).

B. The process of A wherein nitrogen is used as the pressurizing gas.

Figure 2:
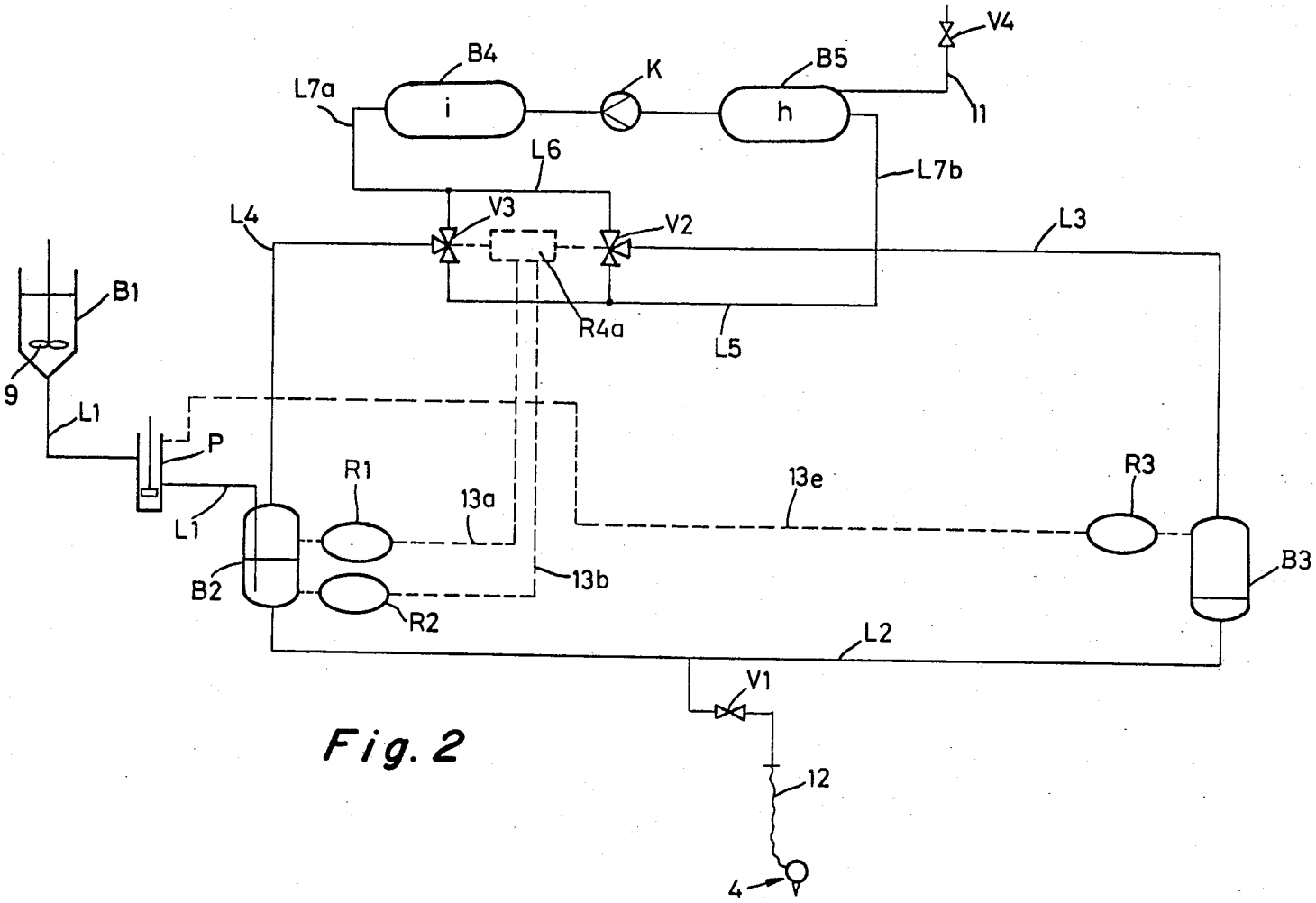

C. A process as shown in FIG. 2 for supplying painting lines, in particular the spraying points in spray booths, with paint material, wherein a length of pipe (L2), used for supplying the paint-spraying points (4) with paint, has a pressure vessel (B2, B3) at both ends, the pressure vessels being subjected to a pressurizing gas via a control system (L3, L4) in such a way that the paint material is conveyed in alternating directions through the pipe (L2), a quantity of paint (in B1) corresponding to that consumed being fed via a pump (P) to the pressurized system.

Figure 3:
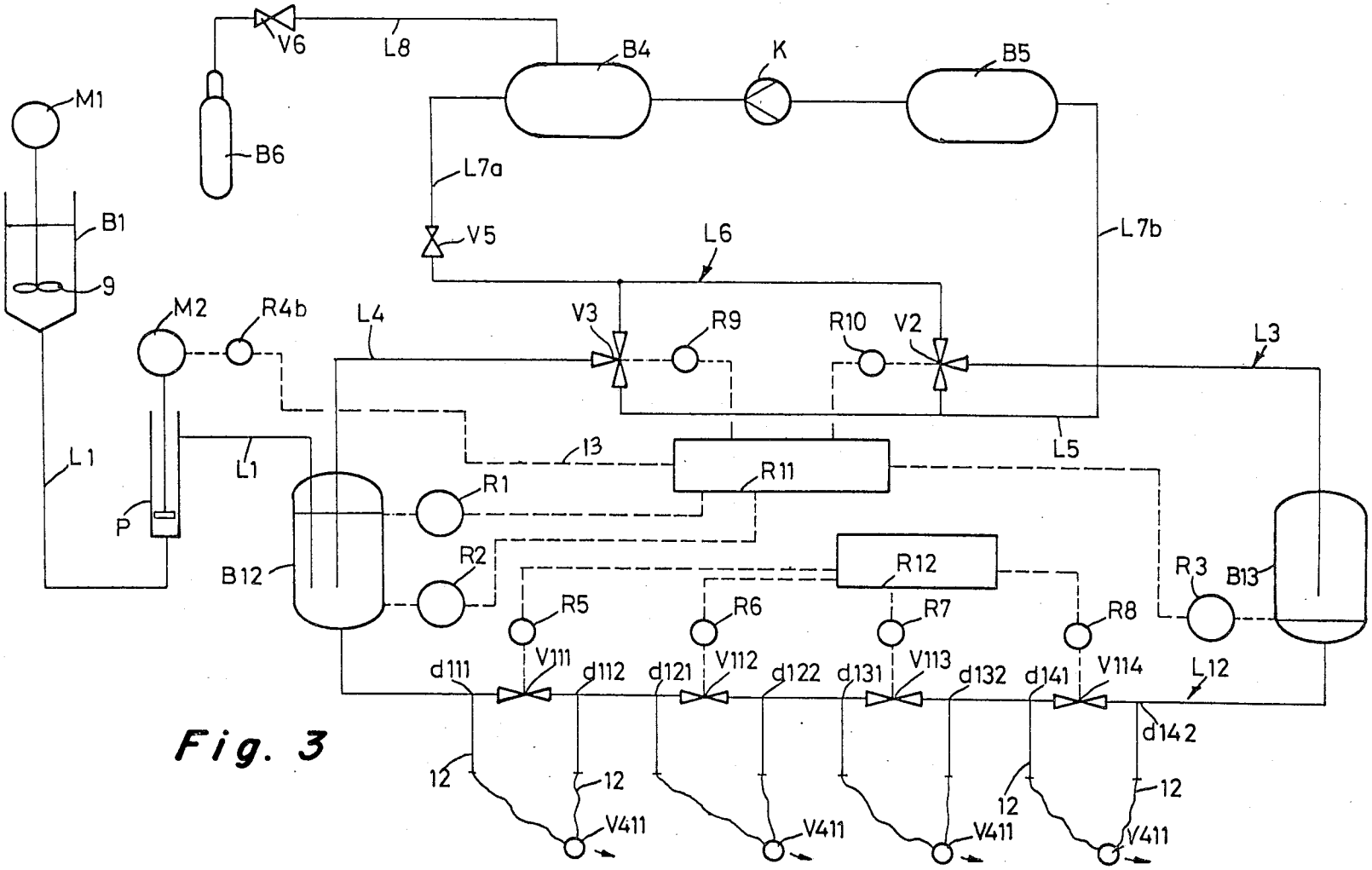

D. The process of C as shown in FIG. 3, wherein the pressurizing gas is held at two different pressure levels by means of a controlled compressor unit (K) and the pressurizing gas is circulated for re-use (by V2 and V3).

E. The process of C and D, wherein several paint supply lines (12) are operated simultaneously by the compressor unit and pressurizing gas supply.

F. The process C and D, with an alternating-flow paint line, wherein the spray guns (V411) are connected via two hoses (12) to the same alternating-flow paint line (L12) and, between the two connections (d111-d112, d121-d122, d131-d132, d141-d142) a solenoid valve (V111, V112, V113, V114) is provided which is fully closed and fully opened at intervals by means of a time switch, (R11, R12), whereby the feed hoses and return hoses are cyclically and alternately flushed with paint material up to the spray gun.

Figure 4A:
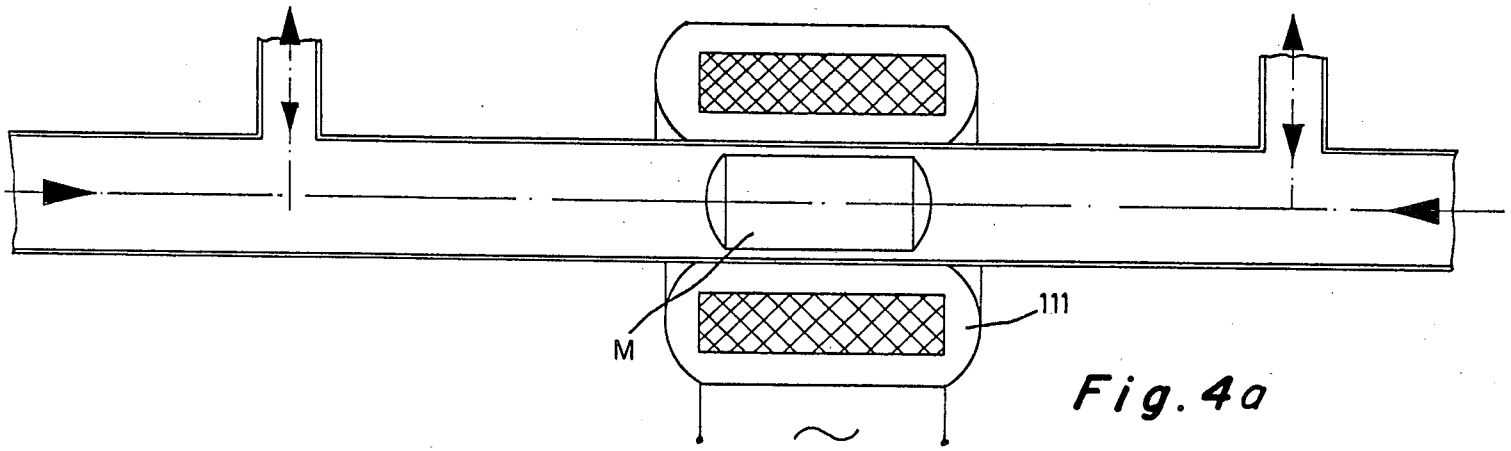
Figure 4B:
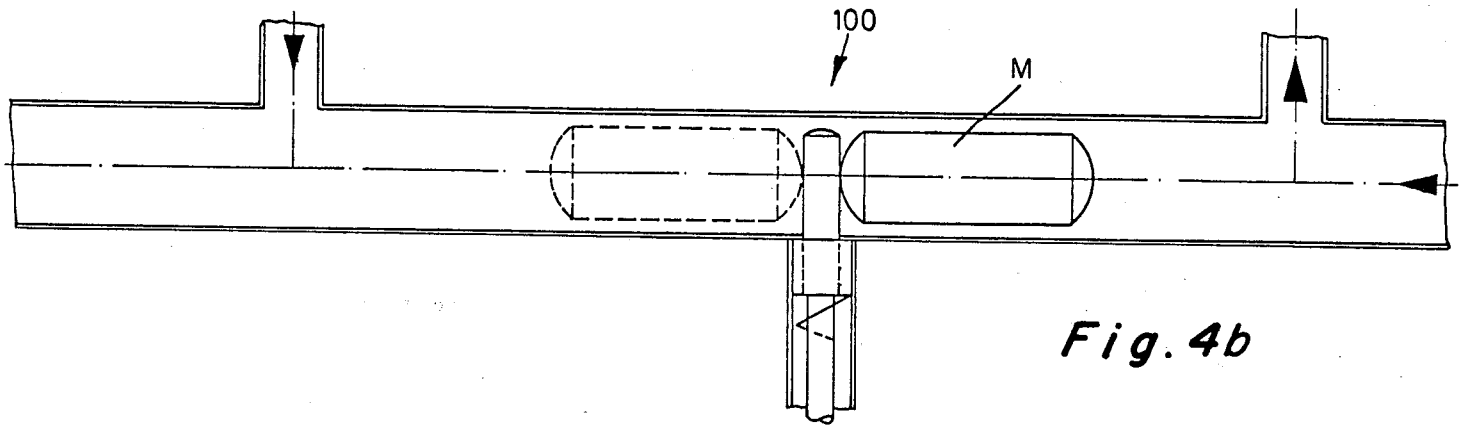

G. The process of F as shown in FIG. 4, wherein a pig (M) is inserted into the alternating-flow line (L2, L12), which pig is alternately driven through the pipe by the paint material and, at the points between the hose connections of a spraying point, an intermittently operated holding device (100,111) for the pig is provided, temporarily stopping the pig so that paint material then flows through the hose connections to the spray gun.

The devices characterizing the equipment according to the invention are defined in the equipment claims.

Figure 5:
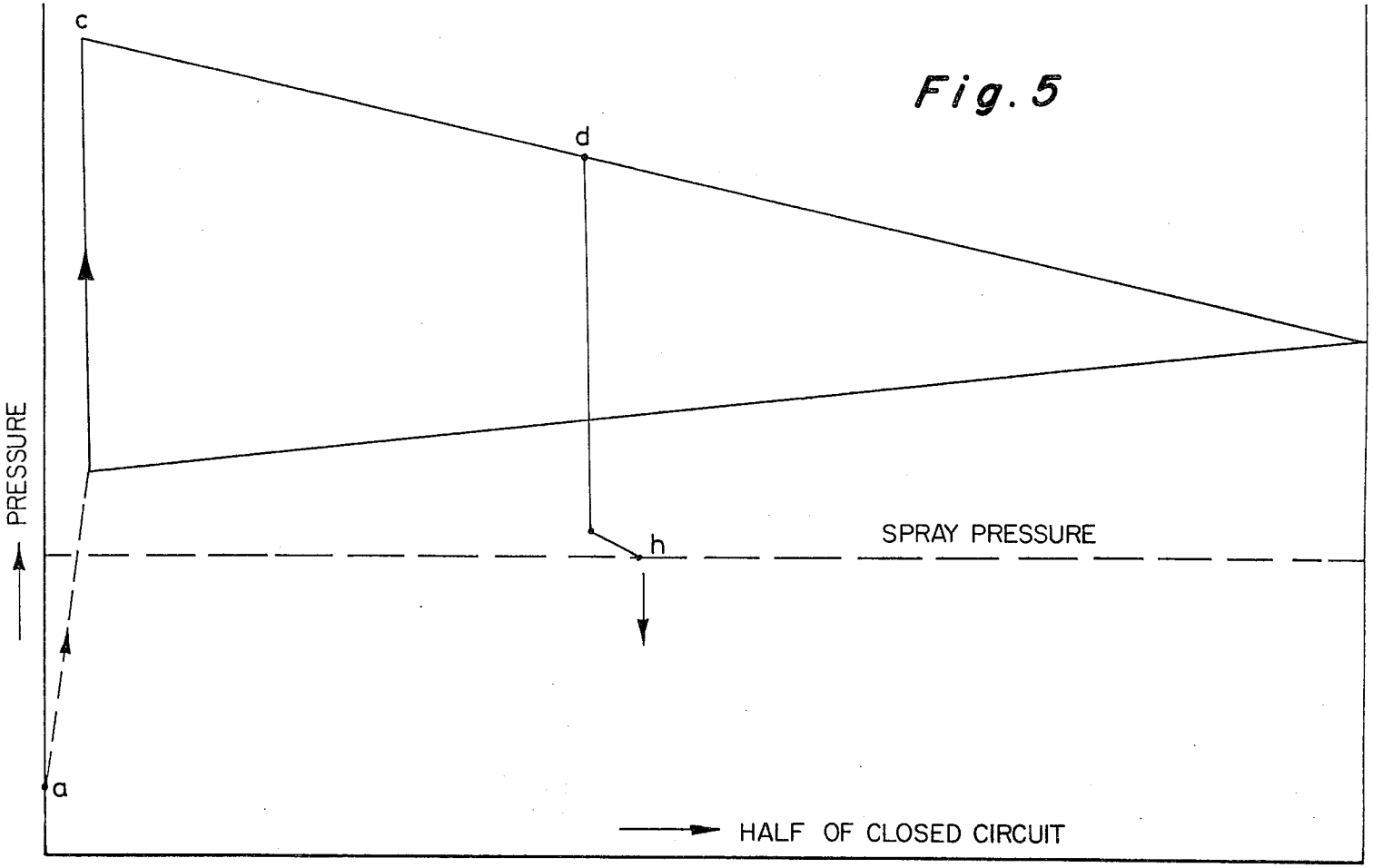
Figure 6:
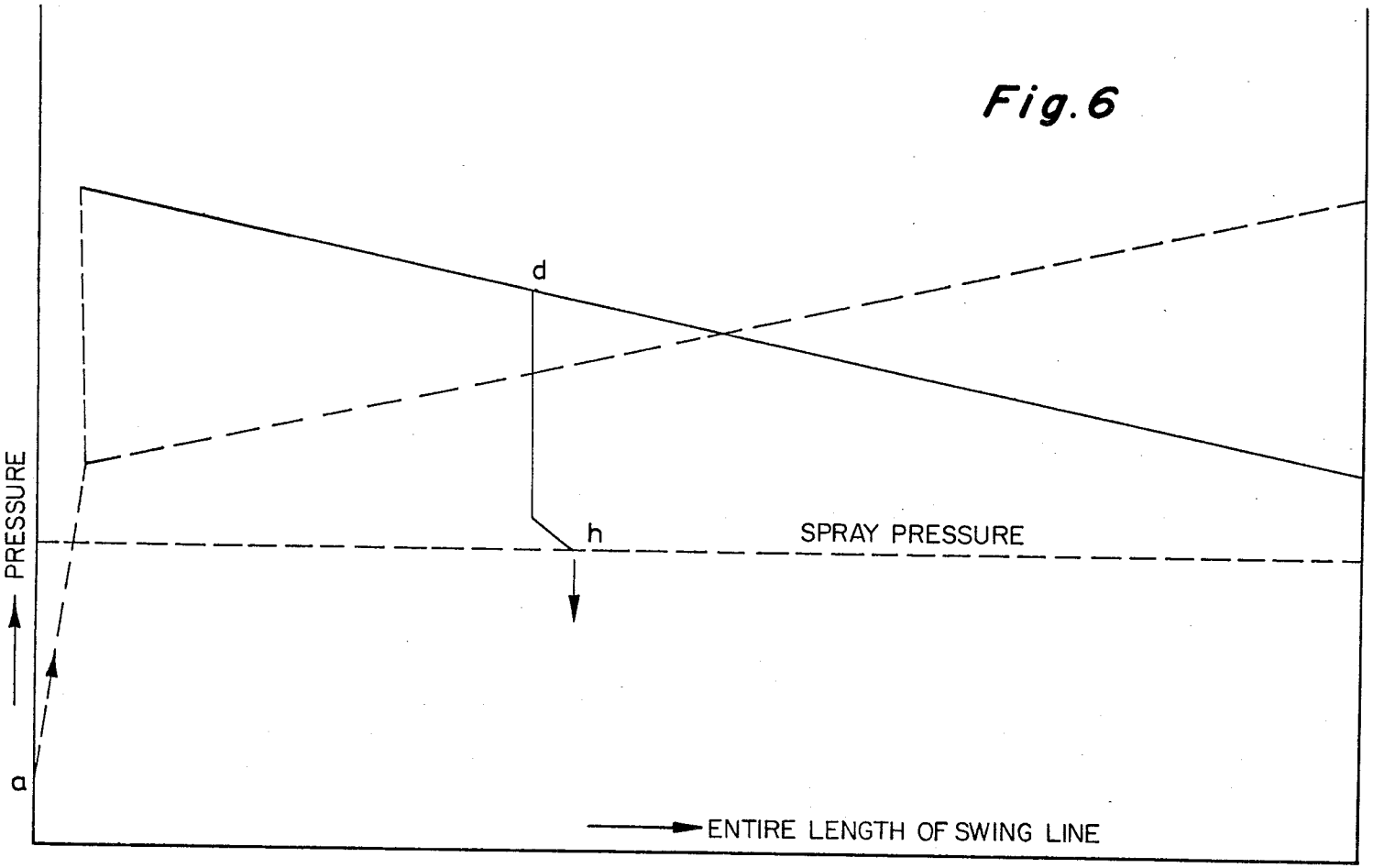

In the following text, illustrative embodiments of the invention are explained by reference to the drawings in which FIG. 1 shows a circulation ring main in which the pressure is maintained by a nitrogen blanket, FIG. 2 shows an alternating-flow paint line which is fitted with a pressure vessel at both ends, FIG. 3 shows an alternating-flow paint line with flushing of the spraying connections, FIGS. *4a* and *4b* show the arrangement of a pig and FIGS. 5 and 6 show pressure diagrams of the systems according to FIG. 1 and FIG. 2 respectively.

In the arrangement according to FIG. 1, a ring main installation 1 is provided which can consist essentially of a pipe in which the paint material is conveyed in circulation by means of a circulation pump 2. The starting point and end point of this ring main system 1 is a pressure vessel 3, from which paint material is drawn by the circulation pump 2 and delivered back into it.

The essential point is that an elevated pressure is set by means of a pressurizing gas above the liquid level within the pressure vessel 3. This elevated static pressure prevails in the entire ring main system, and it should be sufficiently high to ensure that an adequate pressure level is available at each spraying point 4. With this system concept, the circulation pump 2 only has to compensate the dynamic pressure drop due to the flow in the pipe instead of the sum of the dynamic pressure drop and the static pressure, as in prior installations. Moreover, the return flow control valve which, in prior installations must throttle the return flow of paint by 3 to 5 bar, is dispensed with.

A level controller 8 for the quantity of paint in the pressure vessel 3 ensures that fresh paint material is fed to the pressurized system via an unpressurized paint batch vessel 5 with stirrer 9 and a second but smaller pump 6. Vessel 5 is connected to pump 6 via conduit 10*a*. This pump 6 must overcome the full static pressure difference, but the paint material is delivered only once by this pump through line 10*b*. The pipe length of this system concept would correspond to the length of the prior installations.

The essential advantage of this embodiment is that the paint material is circulated with a substantially reduced intensity of shear stress. Moreover, it is easier to keep the upstream pressure at the spraying points 4 constant.

Nitrogen can be used as the pressurizing gas from line 11. Oxidizing influences, hitherto experienced, on the paint material are thus eliminated.

The pressure diagram for this system can be seen in FIG. 5. The paint batch vessel 5 is unpressurized, that is to say the pressure a prevails therein. The pressure is then raised by the piston pump 6 to the value c. The pressure points for the spray guns at 4 are located in the areas marked d, and the pressure is here adjusted via material pressure controllers 7 through conduits 12 according to FIG. 1 to the spraying pressure h. Dashed line 13*c* represents an electrical connection between pump 6 and level controller 8.

FIG. 2 shows a system with pressure vessels located at both ends of the pressurized system.

In this installation, a length of pipe L 2 is provided which does not have a separate return line so that, compared with the installation shown in FIG. 1, only half the pipe length is required. In this installation, however, two pressure vessels B 2 and B 3 are provided which are located at the two ends of the length of pipe L 2. The paint material is conveyed in alternating directions to and fro in the length of pipe L 2 under an elevated static pressure which is generated by a pressurizing gas blanket above the particular liquid level in the pressure vessels B 2 and B 3. For this purpose, the gas pressure in the vessel B 2 is in one case set somewhat higher than the gas pressure in the pressure vessel B 3, and this is subsequently reversed. Via level controllers R1, R2 and R3 in the two pressure vessels B2 and B3, the pressure switch-over cycles are controlled to ensure that a gas breakthrough in the length of pipe L 2 is prevented. The capacities of the vessels B 2 and B 3 should be twice or three times that of the actual pipe volume of the length L 2 so that the material present in the pipe can thus be fully exchanged and back-mixed after each alternating cycle.

As a result of the alternating cycle, the flow in the pipe does not only take place in one direction, but alternately in both directions. To an even greater extent, this prevents depositions of particles on the pipe wall and, in particular, on flange positions and similar uneven transitions. Moreover, the starting flows continually generated on reversing produce temporarily turbulent flow characteristics which largely prevent the deposition of particles. This makes it possible to adopt lower mean flow velocities of, for example, less than 0.3 m/s. Moreover, it is possible not to alternate the flow continuously but cyclically with intervals at a standstill.

Pressurizing gas is supplied to the pressure vessels B 2 and B 3 via the pressurizing gas vessels B 4 and B 5 and the lines L 3, L 4, L 5 and L 6 and L7*a* and L7*b*. K marks a compressor which compresses the pressurizing gas at the pressure stage h from the pressure vessel B 4 into the pressure vessel B 5 and up to the pressure stage i.

In FIG. 2, 3-way valves V 2 and V 3 are drawn, which are controlled by the level controllers R1, R2 and R3 of the pressure vessels B 2 and B 3, these 3-way valves charging the pressure vessels B 2 and B 3 alternately with the higher gas pressure i from the pressure vessel B 4 or the lower gas pressure h from the pressure vessel B 5. Dashed lines 13*a* and 13*b* represent the electrical connections between switching circuit R4*a* and the level controllers. Dashed line 13*c* represents the electrical connection between level controller R 3 and pump P. The effective pressure difference (pressure i minus pressure h) is responsible for the mean flow velocity in the line L 2 whilst the pressure h corresponds to the lowest static supply system pressure which acts as the constant upstream pressure at the spraying points (see FIG. 6).

Agitation means 9 is located in container B1 and compressed gas enters line 11 through valve V4.

The compressor K with the associated pressurizing gas vessels B 4 and B 5 can deliver to several paint supply systems simultaneously, and only one compressor needs therefore to be installed. Since the pressurizing gas is circulated, the gas losses and also the solvent losses are small and it is advisable to use nitrogen as the gas.

Nitrogen increases the operational safety of the pressure vessels B 2 and B 3 and prevents oxidative changes to the paint material.

The level controllers R1, R2 and R3 of the pressure vessels B 2 and B 3 also ensure that the paint material consumed on spraying is fed from the paint batch vessel B 1, in which atmospheric pressure a prevails, via the pump P in sufficient amount as fresh paint to the pressurized system via the line L 1.

If the painting line contains spraying points 4 which are only rarely in operation since, for example, they are used for paint materials having rarely used hues, the tap lines and hose lines from the ring main or alternating-flow line up to the spray gun must be flushed with paint material in order to prevent deposition of particles.

The material pressure controllers which may be required are marked V 1 in FIG. 2.

FIG. 3 finally shows how the object of the invention is achieved by means of a so-called alternating-flow paint line with flushing of the spraying point connections.

Solenoid valves $V_{111}$ to $V_{114}$ are inserted in the alternating-flow line L 12 between the tap lines 12 and hose connections $d_{111}$ to $d_{142}$. At a particular time these solenoid valves are either fully opened or fully closed. The flow of paint is then not restricted. However, it is necessary that always only one single solenoid valve is closed at any one time. A time switch can control which solenoid valve is closed at what time and for how long. It is immaterial here whether the paint flows in the alternating-flow line from the right to the left or vice versa. The essential point is that, with the solenoid valve closed, the differential pressure in the pressure vessels B 12 and B 13 initiates a flow of paint in the tap line up to the spray gun.

It suffices when this flow at each spraying point is generated at intervals for a brief period. The pressure-reducing valves $V_{411}$ are fixed directly to the spray gun. The supply of paint to the spray gun is in any case ensured independently of whether the corresponding solenoid valve is closed or open. By means of the time switch, the intervals and the closing periods of the solenoid valves can be adjusted individually to the paint material.

Compressed gas conduit L7 includes valve V5 and the compressed gas is fed to the system from a reservoir B6 and a compressed gas conduit L8 with valve V6 therein. The drawing moreover schematically shows dashed lines from R11 and R12 representing electrical connections to R1, R2, R3, R4*a*, R5, R6, R7, R8, R9, and R10. The controls for the magnetic valves V111, V112, V113, and V114 are referenced by R5, R6, R7, and R8, respectively. The drive motor for stirrer 9 is designated M1 in FIG. 3 and the drive motor for pump P is designated M2, both in schematic manner, while the regulation means for motor M2 is switching circuit R4*b*. Regulating means for the three-way valves V2 and V3 are R9 and R10.

The remaining components of the arrangement according to FIG. 3 are marked with the same reference symbols as the arrangement according to FIG. 2.

In the arrangement according to FIG. 4, two possible control systems for a so-called pig M are shown. In one arrangement, the pig is controlled via a mechanical ram device 100, whilst a magnetic blocking device 111 is provided for the pig M containing an iron core, in the other arrangement.

The object of the pig is to keep the alternating-flow line free from scale and deposits. It can accomplish this at very low flow velocities, and it must fulfil this task during alternating movement.

At the same time, the pig is intended to replace the solenoid valves. This is possible when it is temporarily stopped between the tap lines leading to the spray guns and thus blocks the main flow direction in the alternating-flow line so that the flow of paint must take place via the tap line. The stopping and temporary holding of the pig in set positions in the alternating-flow line can, for example, be effected via an induction coil or a mechanical device.

We claim:

1. A process for supplying coating material to at least one spraying point located along a paint line, comprising:

(a) providing said paint line as a closed circuit;

(b) locating a pressurized vessel having an inlet and an outlet in said closed circuit;

(c) supplying said pressurized vessel with said coating material under pressure to maintain a liquid level in said pressurized vessel;

(d) supplying a pressurized gas above said liquid level in said pressurized vessel to maintain a pressure level on said coating material for paint spraying at said spraying point; and (e) providing a pump in said closed circuit for recirculating said coating material from said spraying point to said pressurized vessel.

2. The process of claim 1, wherein step (c) is carried out with a second pump and said pressurized gas of step (d) is nitrogen.

3. A process for supplying coating material to at least one spraying point located along a paint line, comprising:

(a) providing first and second pressurized vessels at each end of said paint line;

(b) supplying at least one of said pressurized vessels with said coating material under pressure to maintain first and second liquid levels in said pressurized vessels;

(c) supplying a pressurized gas above said first liquid level at a given pressure to maintain a pressure level on said coating material for paint spraying at said spraying point and passing said coating material to said second pressurized vessel; and (d) supplying said pressurized gas above said second liquid level at a pressure in excess of said given pressure to maintain said pressure level for paint spraying and passing said coating material back to said first pressurized vessel.

4. The process of claim 3, wherein step (b) is carried out with a pump and said pressurized gas of steps (c) and (d) is nitrogen.

5. The process of claim 4, wherein said pressurized gas of said first pressurized vessel is compressed and circulated for reuse.

6. The process of claim 5, wherein a plurality of said paint lines are operated simultaneously.

7. The process of claim 5, wherein said spraying point is connected via feed and return hoses to said paint line and, between the feed and return hose connections, a solenoid valve is provided which is fully closed and fully opened at intervals, whereby the feed hoses and return hoses are cyclically and alternately flushed with paint material up to said spraying point.

8. The process of claim 5 wherein said spraying point is connected via feed and return hoses to said paint line and a pig is inserted into said paint line, said pig being alternately driven through the line by the paint material and, at the points between the feed and return hose connections of a spraying point, an intermittently operated holding device for the pig is provided, temporarily stopping the pig so that paint material then flows through the hose connections to said spray point.

9. An apparatus for supplying coating material to at least one spraying point located along a paint line, comprising:

(a) means for providing said paint line in a closed circuit;

(b) a pressurized vessel having an inlet and an outlet connected in line in said closed circuit;

(c) means for supplying said pressurized vessel with said coating material under pressure to maintain a liquid level in said pressurized vessel;

(d) means for supplying a pressurized gas above said liquid level in said pressurized vessel to maintain a pressure level on said coating material for paint spraying at said spraying point; and (e) a pump in said closed circuit for recirculating said coating material from said spraying point to said pressurized vessel.

10. The apparatus of claim 9, wherein said means of step (c) is a second pump and said means for supplying of step (d) is nitrogen under pressure.

11. An apparatus for supplying paint material to at least one spraying point located along a coating line, comprising:

(a) said paint line having a first end and a second end;

(b) a first pressurized vessel connected to said first end;

(c) a second pressurized vessel connected to said second end;

(d) means for supplying at least one of said pressurized vessels with said coating material under pressure to maintain first and second liquid levels in said pressurized vessels;

(e) means for supplying a pressurized gas above said first liquid level at a given pressure to maintain a pressure level on said coating material for paint spraying at said spraying point and passing said coating material to said second pressurized vessel; and (f) means for supplying said pressurized gas above said second liquid level at a pressure in excess of said given pressure to maintain said pressure level for paint spraying and passing said coating material back to said first pressurized vessel.

12. The apparatus of claim 11, wherein said means (d) is a pump and said means (e) and (f) are nitrogen under pressure.

13. The apparatus of claim 12, further comprising means for compressing and circulating said pressurized gas of said first pressurized vessel for reuse.

14. The apparatus of claim 12, wherein said spraying point is connected via feed and return hoses to said paint line and, between the two connections, a solenoid valve is provided which is fully closed and fully opened at intervals, whereby the feed hoses and return hoses are cyclically and alternately flushed with point material up to said spraying paint.

15. The apparatus of claim 14, wherein a pig is inserted into said paint line, said pig being alternately driven through the line by the paint material and, at the points between the hose connections of a spraying point, an intermittently operated holding device for the pig is provided, temporarily stopping the pig so that paint material then flows through the hose connections to said spray point.

* * * * *